US011460158B1

(12) United States Patent
Wang

(10) Patent No.: US 11,460,158 B1
(45) Date of Patent: Oct. 4, 2022

(54) RECESSED DOWNLIGHT WITH FLEXIBLE INSTALLATION STRUCTURE

(71) Applicant: Jinhua Dalv Technology Co., Ltd., Shenzhen (CN)

(72) Inventor: Pengrui Wang, Shenzhen (CN)

(73) Assignee: E-LITE LIGHTING CO., LTD.

( * ) Notice: Subject to any disclaimer, the term of this patent is extended or adjusted under 35 U.S.C. 154(b) by 0 days.

(21) Appl. No.: 17/683,399

(22) Filed: Mar. 1, 2022

(51) Int. Cl.

| | |
|---|---|
| ***F21S 8/02*** | (2006.01) |
| ***F21V 19/02*** | (2006.01) |
| ***F21V 29/70*** | (2015.01) |
| *F21Y 115/10* | (2016.01) |

(52) U.S. Cl.
CPC ..... *F21S 8/026* (2013.01); *F21V 19/02* (2013.01); *F21V 29/70* (2015.01); *F21Y 2115/10* (2016.08)

(58) Field of Classification Search
CPC ..... F21S 8/026; F21V 19/02; F21V 29/70; F21Y 2115/10
See application file for complete search history.

(56) References Cited

U.S. PATENT DOCUMENTS

2008/0180961 A1* 7/2008 Gibson ..... F21V 15/01 362/364
2015/0153025 A1* 6/2015 Wu ..... F21V 21/046 362/282
2019/0072258 A1* 3/2019 Tan ..... F21K 9/20

FOREIGN PATENT DOCUMENTS

CN 209130660 U * 7/2019

OTHER PUBLICATIONS

English Translation of Qi, CN-209130660-U, published Jul. 2019 (Year: 2019).*

* cited by examiner

*Primary Examiner* — Evan P Dzierzynski

(57) ABSTRACT

A recessed downlight with flexible installation structure includes a mounting plate provided with an installation hole and a heat dissipation housing; the downlight installation structure further comprises an introducing module and a guiding structure; the introducing module is arranged on an inner edge of the installation hole and is fixedly connected to the mounting plate; the heat dissipation housing is provided with a guiding structure, and the guiding structure is configured to surround the outer edge of the heat dissipation housing; when the heat dissipation housing is arranged in the installation hole in a penetrating manner, the guiding structure is connected to the introducing module in a paired manner, thereby enabling the heat dissipation housing to be movably arranged on the mounting plate; an LED module with adjustable angle is arranged in the heat dissipation housing.

9 Claims, 4 Drawing Sheets

RECESSED DOWNLIGHT WITH FLEXIBLE INSTALLATION STRUCTURE

TECHNICAL FIELD

This invention generally relates to the technical field of lighting fixtures, and more particularly, to a recessed downlight with flexible installation structure.

BACKGROUND

Except for the illuminating function, recessed downlights are used to concentrate light rays on particular areas by using optical components to highlight products. Presently, LED spotlights and atmosphere lights have emerged on the market. Conventional recessed downlights normally have a fixed light projection, and LED spotlights need a pre-design of illuminating angle and range before installation.

Recessed downlights are primarily installed in the ceiling. Installation holes are formed in the ceiling and the recessed downlights are installed in the installation holes and fixed in the ceiling by screws. Conventional recessed downlights are normally provided with spring fins on the two sides, and the spring fins abut against the inner side surface of the ceiling such that the recessed downlights are fixed in the installation holes. The installation of recessed downlights is severely restricted by the limited bearing strength of spring fins and the varied thickness of ceilings. Moreover, the self-weight of recessed downlights also affects their stability after installation. For recessed downlights fixed using screws, screw holes need to be pre-formed in the ceiling, which increases the labor cost and makes disassembly and assembly inconvenient.

Especially, for some recessed downlights/spotlights with adjustable angle, space needs to be reserved in the ceiling to permit the movement of recessed downlights. The failure of satisfying the requirements of various ceilings results in narrowed application range of conventional recessed downlights. Therefore, it is urgent for those skilled in the art to develop a recessed downlight with flexible installation structure.

SUMMARY

The purpose of the present invention is to overcome the defects of the prior art and provide a recessed downlight with flexible installation structure, which has a reasonable structure, can be conveniently assembled and disassembled, has high heat dissipation efficiency and can be flexibly installed.

To achieve the above purpose, the present invention adopts the following technical solution: a recessed downlight with flexible installation structure of the present invention comprises a mounting plate and a heat dissipation housing, wherein an installation hole is formed in the mounting plate. The downlight installation structure further comprises an introducing module and a guiding structure, wherein the introducing module is arranged on an inner edge of the installation hole and is fixedly connected to the mounting plate. The heat dissipation housing is provided with a guiding structure, and the guiding structure is configured to surround the outer edge of the heat dissipation housing. When the heat dissipation housing is arranged in the installation hole in a penetrating manner, the guiding structure is connected to the introducing module in a paired manner, thereby enabling the heat dissipation housing to be movably arranged on the mounting plate. An LED module with adjustable angle is arranged in the heat dissipation housing.

In another embodiment of the present invention, the introducing module comprises an introducing sliding block, which is arranged on an inner edge of the installation hole and is fixedly connected to the mounting plate. The introducing sliding block is provided with a spiral introducing slope. The guiding structure comprises a spiral lifting sliding plate, and the lifting sliding plate is configured to surround the outer edge of the heat dissipation housing. The lifting sliding plate is movably arranged on the introducing slope, which enables the heat dissipation housing to horizontally rotate in the installation hole to move up and down. An anti-sliding assembly is arranged between the lifting sliding plate and the introducing sliding block.

In another embodiment of the present invention, the anti-sliding assembly comprises a beam bracket, a pressing block and an elastic plunger piston. The beam bracket is arranged on the outer side of the introducing sliding block, and the lower end of the beam bracket is fixedly connected to the mounting plate. The outer end of the bottom of the pressing block is fixedly connected to the upper end of the beam bracket, which allows the inner end of the bottom of the pressing block to be arranged on the introducing slope. The inner end of the bottom of the pressing block is connected to the upper end of the elastic plunger piston in a matching manner. When the heat dissipation housing is arranged in the installation hole in a penetrating manner, the lower end of the elastic plunger piston presses against the upper surface of the lifting sliding plate such that the lifting sliding plate is fixed on the introducing sliding block.

In another embodiment of the present invention, the lower surface of the lifting sliding plate interacts with the introducing slope of the introducing sliding block in a sliding manner. The upper surface of the lifting sliding plate is provided with an anti-sliding pattern, and the lower end of the elastic plunger piston abuts against the anti-sliding pattern, which enables the lifting sliding plate to be connected to the introducing sliding block in a matched manner.

In another embodiment of the present invention, the LED module comprises a first module, a second module, an LED light source and a lens. The upper opening of the heat dissipation housing is provided with a bottom plate, the first module is arranged in the heat dissipation housing in a penetrating manner, and the first module is rotatably connected to the bottom plate. The second module is arranged below the first module and is connected to the first module by means of a swing structure. The LED light source is fixedly arranged on the second module. The lens covers the LED light source and is fixedly connected to the second module.

In another embodiment of the present invention, the lower end of the first module is provided with a concave spherical surface, and the second module is movably arranged on the concave spherical surface. A sliding groove is formed in the concave spherical surface, and a sliding column is arranged at the upper end of the second module. The sliding column is arranged in the sliding groove in a penetrating manner, and a locking nut is arranged at the upper end of the sliding column.

In another embodiment of the present invention, the upper end of the first module is provided with a hollow threading axis sleeve, the bottom plate is provided with a through hole, and the threading axis sleeve is rotatably arranged in the through hole in a penetrating manner. A limiting nut and an elastic element are arranged at the upper end of the threading axis sleeve.

In another embodiment of the present invention, the lower opening of the heat dissipation housing is provided with a stop ring sleeve, the stop ring sleeve is fixedly connected to the heat dissipation housing, and the outer diameter of the stop ring sleeve is greater than the outer diameter of the heat dissipation housing. The inner hole of the stop ring sleeve is provided with a light-transmitting panel, and the light-transmitting panel is detachably connected to the stop ring sleeve.

In another embodiment of the present invention, the bottom plate is provided with a plurality of heat dissipation fins.

Compared with the prior art, the present invention has the following advantages: the present invention has a reasonable structure; through the interaction between the lifting sliding plate and the introducing module, the heat dissipation housing can be spirally installed in the installation hole; the mounting plate is fixed in the ceiling as a modular structure, which possesses higher bearing strength, satisfies the installation requirements of high-power downlights and achieves convenient assembly and disassembly; the heat dissipation housing can conduct heat to the mounting plate through the introducing sliding block; the increased heat dissipation area of the heat dissipation housing can effectively improve the heat dissipation efficiency of the LED light source; it is unnecessary to rotate the heat dissipation housing when the LED light source is horizontally adjusted, which effectively prevents the wires from being tangled up.

1—Mounting Plate, 2—Heat Dissipation Housing, 3—Introducing Module, 4—LED Module, 11—Installation Hole, 21—Lifting Sliding Plate, 22—Anti-sliding Pattern, 23—Bottom Plate, 24—Limiting Nut, 25—Stop Ring Sleeve, 26—Light-transmitting Panel, 27—Heat Dissipation Fin, 31—Introducing Sliding Block, 32—Introducing Slope, 33—Beam Bracket, 34—Pressing Block, 35—Elastic Plunger Piston, 41—The First Module, 42—The Second Module, 43—LED Light Source, 44—Lens, 45—Concave Spherical Surface, 46—Sliding Groove, 47—Sliding Column, 48—Locking Nut, 49—Threading Axis Sleeve.

DETAILED DESCRIPTION

Figures and detailed embodiments are combined hereinafter to further elaborate the technical solution of the present invention.

Figure 1:
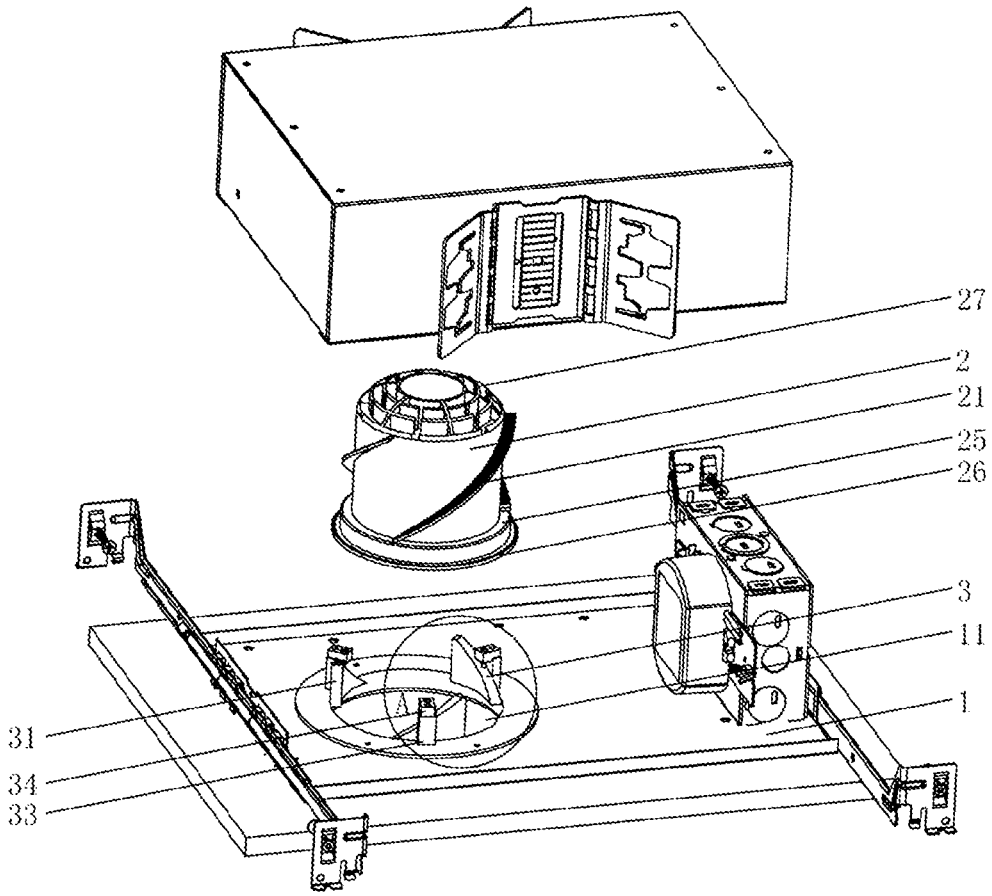
FIG. 1 is a conceptual diagram illustrating an overall example structure of the present invention.
Figure 2:
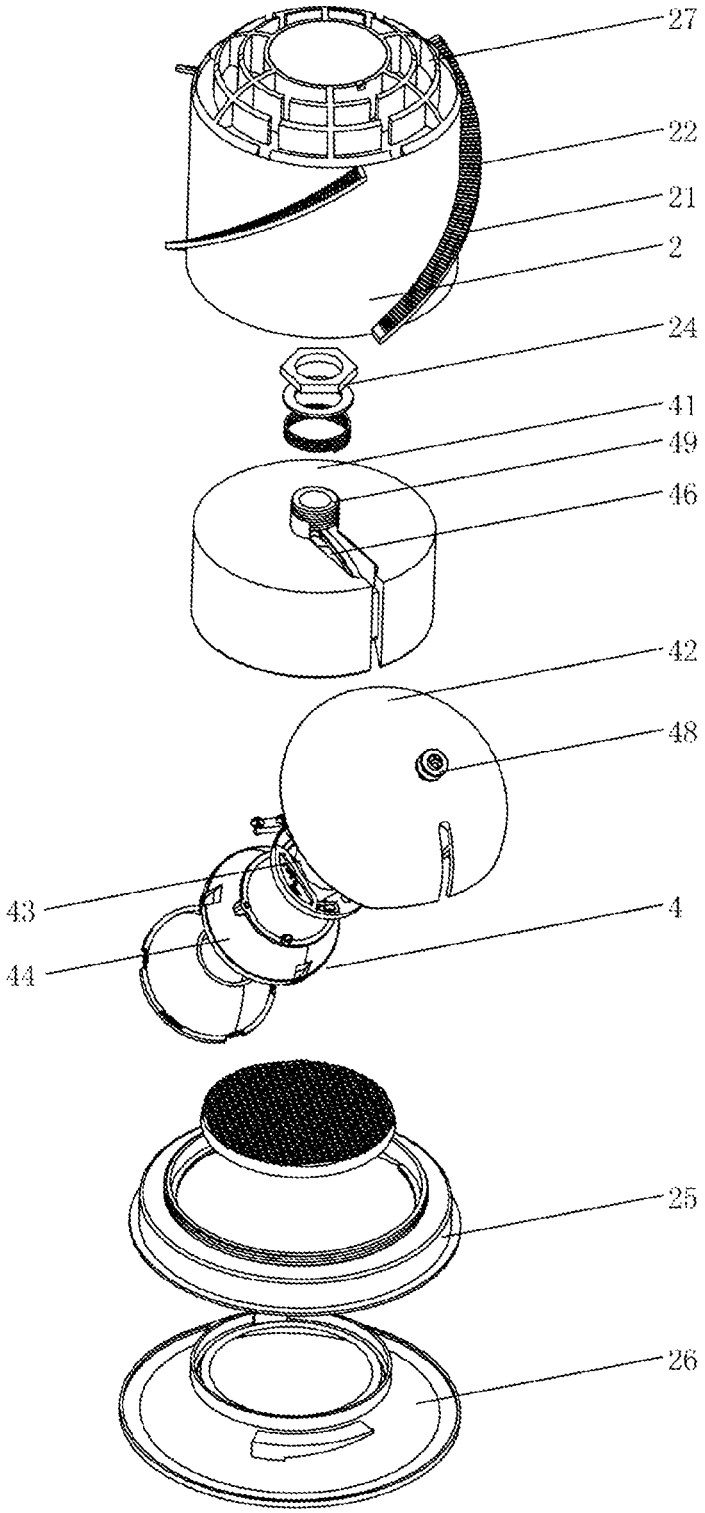
FIG. 2 is a conceptual diagram illustrating an explosive view of the heat dissipation housing and the LED module.
Figure 3:
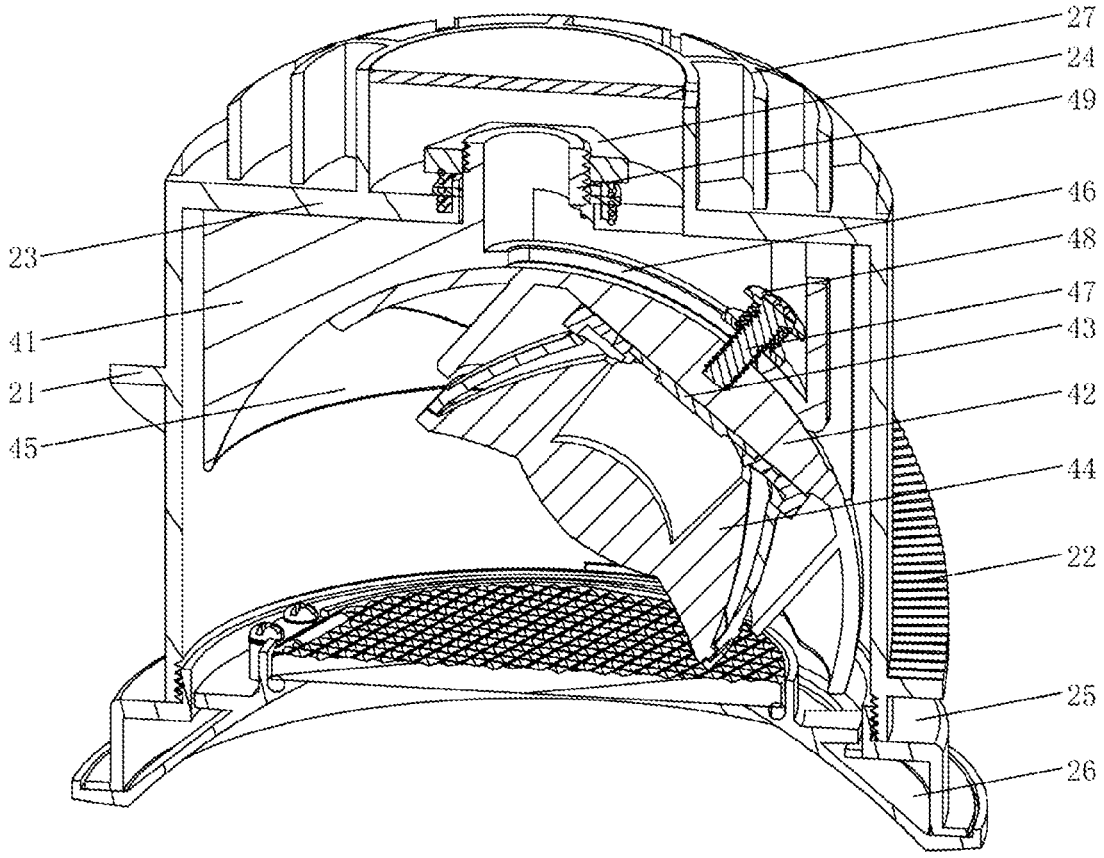
FIG. 3 is a conceptual diagram illustrating a sectional view of the heat dissipation housing.
Figure 4:
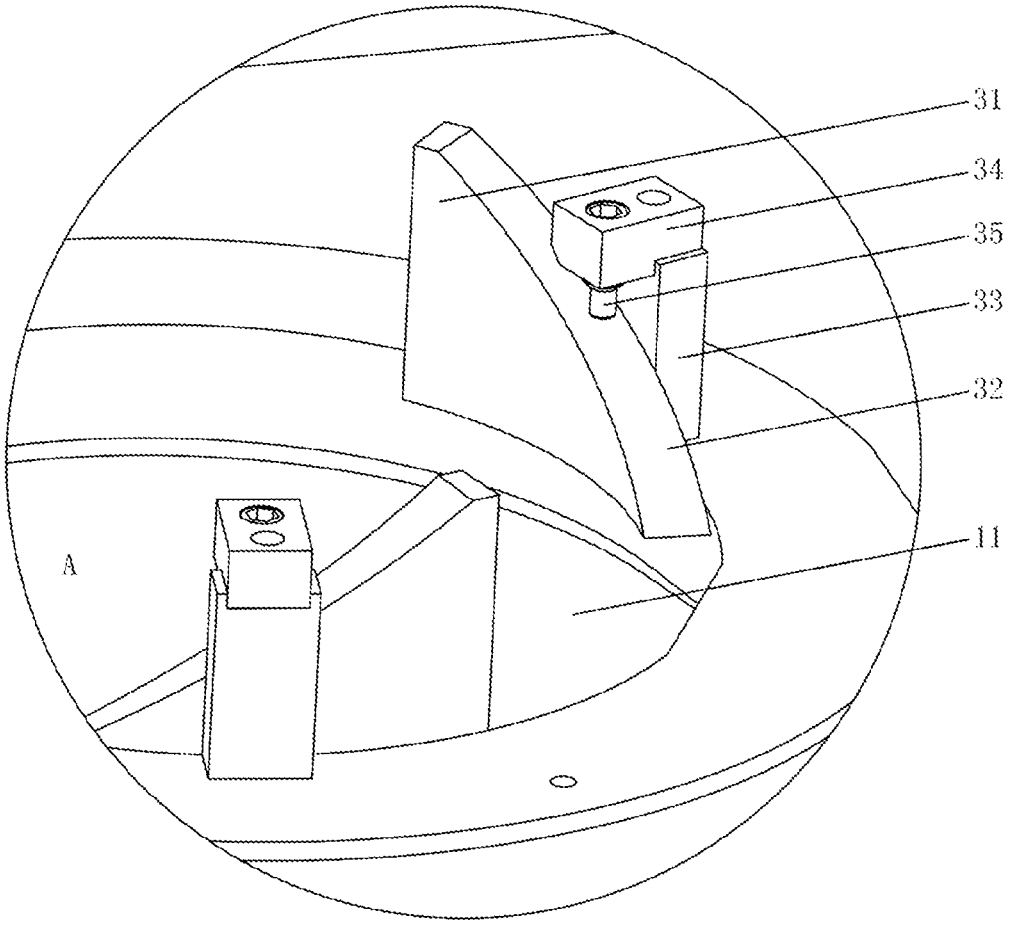
FIG. 4 is a conceptual diagram illustrating an enlarged structure of portion A in FIG. 1.

As shown in FIGS. 1-4, a recessed downlight with flexible installation structure comprises a mounting plate 1 and a heat dissipation housing 2, wherein an installation hole 11 is formed in the mounting plate 1. To allow the mounting plate 1 to be conveniently installed on an integrated ceiling, the mounting plate 1 may adopt a rectangle-shaped modular structure. The mounting plate 1 has a relatively large area for bearing the weight of the downlight. The downlight installation structure of the present invention further comprises an introducing module 3 and a guiding structure, wherein the introducing module 3 is arranged on an inner edge of the installation hole 11 and is fixedly connected to the mounting plate 1. The heat dissipation housing 2 is provided with a guiding structure, and the guiding structure is configured to surround the outer edge of the heat dissipation housing 2. When the heat dissipation housing 2 is arranged in the installation hole 11 in a penetrating manner, the guiding structure is connected to the introducing module 3 in a paired manner, thereby enabling the heat dissipation housing 2 to be movably arranged on the mounting plate 1. An LED module 4 with adjustable angle is arranged in the heat dissipation housing 2. The guiding structure is configured to match with the introducing module 3, which allows the heat dissipation housing 2 to be installed into the installation hole 11 in a spiral manner and fixed on the mounting plate 1. In this way, the convenient disassembly and assembly are achieved. Further, the heat dissipation housing 2 is capable of rotating in the assembly hole 11 to adjust the installation height of the heat dissipation housing 2 on the mounting plate 1, which enables the downlight to fit ceilings with different heights such that the application range of the downlight is significantly widened.

The introducing module 3 comprises an introducing sliding block 31, which is arranged on an inner edge of the installation hole 11 and is fixedly connected to the mounting plate 1. The introducing sliding block 31 is provided with a spiral introducing slope 32. The guiding structure comprises a spiral lifting sliding plate 21, and the lifting sliding plate 21 is configured to surround the outer edge of the heat dissipation housing 2. The lifting sliding plate 21 is movably arranged on the introducing slope 32, which enables the heat dissipation housing 2 to horizontally rotate in the installation hole 11 to move up and down. An anti-sliding assembly is arranged between the lifting sliding plate 21 and the introducing sliding block 31. When the heat dissipation housing 2 rotates in the installation hole 11, the lifting sliding plate 21 slides along the introducing slope 32 on the introducing sliding block 31. Because both the lifting sliding plate 21 and the introducing slope 32 have a spiral shape, the horizontal rotation of the heat dissipation housing 2 is converted into a vertical movement, thereby allowing the heat dissipation housing 2 to be installed in the installation hole. After the heat dissipation housing 2 is installed in place, the lifting sliding plate 21 is locked with the introducing sliding block 31 by means of the anti-sliding assembly. Thus, the downlight is fixed on the mounting plate 11.

The anti-sliding assembly comprises a beam bracket 33, a pressing block 34 and an elastic plunger piston 35. The beam bracket 33 is arranged on the outer side of the introducing sliding block 31, and the lower end of the beam bracket 33 is fixedly connected to the mounting plate 1. The outer end of the bottom of the pressing block 34 is fixedly connected to the upper end of the beam bracket 33, which enables the inner end of the bottom of the pressing block 34 to be arranged on the introducing slope 32. The inner end of the bottom of the pressing block 34 is connected to the upper end of the elastic plunger piston 35 in a matching manner. More specifically, the pressing block 34 is connected to the elastic plunger piston 35 by using screws. An elastic gap exists between the lower end of the elastic plunger piston 35 and the introducing slope 32. When the heat dissipation housing 2 is arranged in the installation hole 11 in a penetrating manner, the lower end of the elastic plunger piston 35 presses against the upper surface of the lifting sliding plate 21 such that the lifting sliding plate 21 is fixed on the introducing sliding block 31. The bottom surface of the lifting sliding plate 21 and the introducing slope 32 are smooth, and the lifting sliding plate 21 is arranged between the introducing slope 32 and the lower end of the elastic plunger piston 35 in a penetrating manner. The elastic plunger piston 35 imposes an elastic force on the introducing slope 32, which is further directed to the lifting sliding plate 21, thereby allowing the heat dissipation housing 2 to overcome the frictional resistance between the lifting sliding plate 21 and the introducing slope 32 by a small torsion. In this way, the lifting sliding plate 21 slides along the introducing slope 32 on the introducing sliding block 31, and the heat dissipation housing 2 rotates horizontally in the installation hole 11. Thus, the convenient assembly and disassembly of the downlight on the mounting plate 1 are achieved. After the heat dissipation housing 2 is installed in the installation hole 11, the lower end of the elastic plunger piston 35 abuts against the lifting sliding plate 21 and imposes an elastic force on the lifting sliding plate 21. Thus, a sufficient frictional resistance is generated between the lifting sliding plate 21 and the introducing slope 32, preventing the downlight from sliding out from the installation hole 11 under the action of self-weight.

The lower surface of the lifting sliding plate 21 interacts with the introducing slope 32 of the introducing sliding block 31 in a sliding manner. The upper surface of the lifting sliding plate 21 is provided with an anti-sliding pattern 22, and the lower end of the elastic plunger piston 35 abuts against the anti-sliding pattern 22. Thus, the lifting sliding plate 21 is connected to the introducing sliding block 31 in a matched manner. The anti-sliding pattern 22 is used for increasing the frictional resistance between the lower end of the elastic plunger piston 35 and the lifting sliding plate 21. Through adopting the aforesaid design, the downlight is effectively protected from sliding out from the installation hole 11 under the action of self-weight.

The LED module 4 comprises a first module 41, a second module 42, an LED light source 43 and a lens 44. The upper opening of the heat dissipation housing 2 is provided with a bottom plate 23, the first module 41 is arranged in the heat dissipation housing 2 in a penetrating manner, and the first module 41 is rotatably connected to the bottom plate 23. The second module 42 is arranged below the first module 41 and is connected to the first module 41 by means of a swing structure. The LED light source 43 is fixedly arranged on the second module 42. The lens 44 covers the LED light source 43 and is fixedly connected to the second module 42. The lower end of the second module 42 is provided with an installation surface. The LED light source 43 is arranged on the installation surface and is fixedly connected to the second module 42. The second module 42 swings laterally on the first module 41, thereby changing the projection angle of the LED light source 43. The first module 41 horizontally rotates on the bottom plate 23 to change the projection point of the LED light source 43.

The lower end of the first module 41 is provided with a concave spherical surface 45, and the second module 42 is movably arranged on the concave spherical surface 45. A sliding groove 46 is formed in the concave spherical surface 45, and a sliding column 47 is arranged at the upper end of the second module 42. The sliding column 47 is arranged in the sliding groove 46 in a penetrating manner, and a locking nut 48 is arranged at the upper end of the sliding column 47. The sliding column 47 is connected to the second module 42 in the sliding groove 46 by the locking nut 48, and the sliding column 47 moves along the sliding groove 46 to enable the second module 42 to swing on the first module 41, thereby changing the projection angle of the LED light source 43.

The upper end of the first module 41 is provided with a hollow threading axis sleeve 49, the bottom plate 23 is provided with a through hole, and the threading axis sleeve 49 is rotatably arranged in the through hole in a penetrating manner. A limiting nut 24 and an elastic element are arranged at the upper end of the threading axis sleeve 49. The lower end of the threading axis sleeve 49 is provided with a notch for communicating with the sliding groove 46, and the LED light source is connected with a wire. After sequentially penetrating through the sliding groove 46, the threading axis sleeve 49 and the upper end of the heat dissipation housing 2, the wire is connected to a controller.

The installation hole 11 is provided with three introducing modules 3, and the heat dissipation housing 2 is correspondingly provided with three lifting sliding plates 21. The spirally rising angle of the lifting sliding plate 21 ranges from 30 to 75 degrees, and preferably, the spirally rising angle of the lifting sliding plate 21 is 45 degrees. Therefore, the maximum rotation angle of the heat dissipation housing 2 is controlled within 120 degrees. Because the rotation range of the heat dissipation housing 2 is small, and the angle adjustment of the LED light source 43 is realized by the first module 41 and the second module 42, the wires of the LED module 4 are effectively prevented from being tangled up.

The lower opening of the heat dissipation housing 2 is provided with a stop ring sleeve 25, the stop ring sleeve 25 is fixedly connected to the heat dissipation housing 2, and the outer diameter of the stop ring sleeve 25 is greater than the outer diameter of the heat dissipation housing 2. The inner hole of the stop ring sleeve 25 is provided with a light-transmitting panel 26, and the light-transmitting panel 26 is detachably connected to the stop ring sleeve 25. The stop ring sleeve 25 is fixed on the lower opening of the heat dissipation housing 2 in a threaded connection manner, and the stop ring sleeve 25 abuts against the mounting plate 1, thereby limiting the upward movement of the heat dissipation housing 2. Preferably, a snap-fit structure is arranged between the light-transmitting panel 26 and the stop ring sleeve 25, and the light-transmitting panel 26 is detachably connected to the stop ring sleeve 25 by means of the snap-fit structure. After the light-transmitting panel 26 is removed, the angle of the LED module 4 can be adjusted.

The bottom plate 23 is provided with a plurality of heat dissipation fins 27 for increasing the surface area of the heat dissipation housing 2 such that the heat dissipation efficiency is improved. Further, the heat dissipation housing 2 conducts heat to the mounting plate 1 by means of the introducing sliding block 31, and the mounting plate 1 assists to dissipate the heat of the heat dissipation housing 2, thereby ensuring the heat dissipation efficiency of the high-power downlight.

The above are merely preferred embodiments of the present invention. Therefore, all equivalent changes or modifications made according to the structures, features and principles described in the scope of the present invention shall fall into the scope of the present invention.

What is claimed is:

1. A recessed downlight with flexible installation structure, comprising:

a mounting plate (1) provided with an installation hole, and a heat dissipation housing (2), wherein the downlight installation structure further comprising:

an introducing module (3) and a guiding structure, wherein the introducing module (3) is arranged on an inner edge of the installation hole (11) and is fixedly connected to the mounting plate (1), wherein the heat dissipation housing (2) is provided with a guiding structure, and the guiding structure is configured to surround the outer edge of the heat dissipation housing (2), wherein when the heat dissipation housing (2) is arranged in the installation hole (11) and penetrates the installation hole, wherein the guiding structure is coupled to the introducing module (3), and enables the heat dissipation housing (2) to be movably arranged on the mounting plate (1), wherein a LED module (4) with adjustable angle is arranged in the heat dissipation housing (2).

2. The recessed downlight with flexible installation structure of claim 1, wherein the introducing module (3) further comprising an introducing sliding block (31) arranged on an inner edge of the installation hole (11) and fixedly connected to the mounting plate (1), wherein the introducing sliding block (31) is provided with a spiral introducing slope (32), wherein the guiding structure further comprising a spiral lifting sliding plate (21), wherein the lifting sliding plate (21) is configured to surround an outer edge of the heat dissipation housing (2), wherein the lifting sliding plate (21) is movably arranged on the introducing slope (32) and enables the heat dissipation housing (2) to horizontally rotate in the installation hole (11), wherein an anti-sliding assembly is arranged between the lifting sliding plate (21) and the introducing sliding block (31).

3. The recessed downlight with flexible installation structure of claim 2, wherein the anti-sliding assembly further comprising a beam bracket (33), a pressing block (34) and an elastic plunger piston (35), wherein the beam bracket (33) is arranged on an outer side of the introducing sliding block (31), wherein the lower end of the beam bracket (33) is fixedly connected to the mounting plate (1), wherein an outer end of bottom of the pressing block (34) is fixedly connected to an upper end of the beam bracket (33), which allows the inner end of the bottom of the pressing block (34) to be arranged on the introducing slope (32), wherein an inner end of the bottom of the pressing block (34) is connected to an upper end of the elastic plunger piston (35), wherein when the heat dissipation housing (2) is arranged in the installation hole (11) in a penetrating manner, wherein a lower end of the elastic plunger piston (35) presses against an upper surface of the lifting sliding plate (21) such that the lifting sliding plate (21) is fixed on the introducing sliding block (31).

4. The recessed downlight with flexible installation structure of claim 3, wherein a lower surface of the lifting sliding plate (21) interacts with the introducing slope (32) of the introducing sliding block (31) in a sliding manner, wherein an upper surface of the lifting sliding plate (21) is provided with an anti-sliding pattern (22), and a lower end of the elastic plunger piston (35) abuts against the anti-sliding pattern (22), which enables the lifting sliding plate (21) to be connected to the introducing sliding block (31).

5. The recessed downlight with flexible installation structure of claim 1, wherein the LED module (4) further comprising:

a first module (41), a second module (42), an LED light source (43) and a lens (44), wherein an upper opening of the heat dissipation housing (2) is provided with a bottom plate (23), the first module (41) is arranged in the heat dissipation housing (2) and penetrates the heat dissipation housing, and the first module (41) is rotatably connected to the bottom plate (23), wherein the second module (42) is arranged below the first module (41) and is connected to the first module (41) by means of a swing structure, wherein the LED light source (43) is fixedly arranged on the second module (42), wherein the lens (44) covers the LED light source (43) and is fixedly connected to the second module (42).

6. The recessed downlight with flexible installation structure of claim 5, wherein a lower end of the first module (41) is provided with a concave spherical surface (45), and the second module (42) is movably arranged on the concave spherical surface (45), wherein a sliding groove (46) is formed in the concave spherical surface (45), wherein a sliding column (47) is arranged at an upper end of the second module (42), wherein the sliding column (47) is arranged in the sliding groove (46) and penetrates the sliding groove, and wherein a locking nut (48) is arranged at the upper end of the sliding column (47).

7. The recessed downlight with flexible installation structure of claim 5, wherein an upper end of the first module (41) is provided with a hollow threading axis sleeve (49), the bottom plate (23) is provided with a through hole, and the threading axis sleeve (49) is rotatably arranged in the through hole and penetrates the through hole, wherein a limiting nut (24) and an elastic element are arranged at an upper end of the threading axis sleeve (49).

8. The recessed downlight with flexible installation structure of claim 5, wherein a lower opening of the heat dissipation housing (2) is provided with a stop ring sleeve (25), wherein the stop ring sleeve (25) is fixedly connected to the heat dissipation housing (2), wherein an outer diameter of the stop ring sleeve (25) is greater than an outer diameter of the heat dissipation housing (2), wherein an inner hole of the stop ring sleeve (25) is provided with a light-transmitting panel (26), and wherein the light-transmitting panel (26) is detachably connected to the stop ring sleeve (25).

9. The recessed downlight with flexible installation structure of claim 5, wherein the bottom plate (23) is provided with a plurality of heat dissipation fins (27).

* * * * *